US005867137A

United States Patent [19]

Sugiyama

[11] Patent Number: 5,867,137

[45] Date of Patent: Feb. 2, 1999

[54] DISPLAY CONTROL DEVICE AND METHOD FOR GENERATING DISPLAY DATA TO DISPLAY IMAGES IN GRAY SCALE

[75] Inventor: Mikio Sugiyama, Tokyo, Japan

[73] Assignee: NEC Corporation, Tokyo, Japan

[21] Appl. No.: 534,595

[22] Filed: Sep. 27, 1995

[30] Foreign Application Priority Data

Sep. 29, 1994 [JP] Japan ..... 6-235304

[51] Int. Cl.[6] ..... G09G 3/36; G09G 5/10

[52] U.S. Cl. ..... 345/89; 345/147

[58] Field of Search ..... 345/89, 147, 153, 345/154, 150, 148, 152, 87, 88; 386/46, 78, 79, 30; 359/30; 349/2

[56] References Cited

U.S. PATENT DOCUMENTS

| | | | |
|---|---|---|---|
| 5,062,001 | 10/1991 | Farwell et al. | 345/147 |
| 5,119,086 | 6/1992 | Nishioka et al. | 345/147 |
| 5,153,568 | 10/1992 | Shaw | 345/147 |
| 5,185,674 | 2/1993 | Tai | 358/457 |
| 5,196,839 | 3/1993 | Johary et al. | 345/148 |
| 5,225,875 | 7/1993 | Shapiro et al. | 345/150 |
| 5,389,948 | 2/1995 | Liu | 345/147 |
| 5,534,883 | 7/1996 | Koh | 345/89 |
| 5,543,819 | 8/1996 | Farwell et al. | 345/150 |

*Primary Examiner*—Jeffery Brier
*Assistant Examiner*—David L Lewis
*Attorney, Agent, or Firm*—Sughrue, Mion, Zinn, Macpeak & Seas, PLLC

[57] ABSTRACT

In a flat type display device, a display control device comprising display data generation means for sequentially comparing scale number of a display picture element and each frame number of frames necessary to display images in gray scale, and generating display data for the display picture element based on the comparison result.

18 Claims, 9 Drawing Sheets

Fig.3

| COPMAR IN | | | CASCAD IN | | | OUT | | |
|---|---|---|---|---|---|---|---|---|
| A2, B2 | A1,B1 | A0,B0 | A<B | A=B | A>B | A<B | A=B | A>B |
| A2>B2 | X | X | X | X | X | 0 | 0 | 1 |
| A2<B2 | X | X | X | X | X | 1 | 0 | 0 |
| A2=B2 | A1>B1 | X | X | X | X | 0 | 0 | 1 |
| A2=B2 | A1=B1 | A0>B0 | X | X | X | 0 | 0 | 1 |
| A2=B2 | A1=B1 | A0<B0 | X | X | X | 1 | 0 | 0 |
| A2=B2 | A1=B1 | A0=B0 | 0 | 0 | 1 | 0 | 0 | 1 |
| A2=B2 | A1=B1 | A0=B0 | X | 1 | X | 0 | 1 | 0 |
| A2=B2 | A1=B1 | A0=B0 | 1 | 0 | 0 | 1 | 0 | 0 |
| A2=B2 | A1=B1 | A0=B0 | 1 | 0 | 1 | 0 | 0 | 0 |
| A2=B2 | A1=B1 | A0=B0 | 0 | 0 | 0 | 1 | 0 | 1 |

Fig.4

| | | FRAME NUMBER | | | | | | | |
|---|---|---|---|---|---|---|---|---|---|
| | | 0 | 1 | 2 | 3 | 4 | 5 | 6 | 7 |
| SCALE NUMBER | 1 | 1 | 0 | 0 | 0 | 0 | 0 | 0 | 0 |
| | 2 | 1 | 1 | 0 | 0 | 0 | 0 | 0 | 0 |
| | 3 | 1 | 1 | 1 | 0 | 0 | 0 | 0 | 0 |
| | 4 | 1 | 1 | 1 | 1 | 0 | 0 | 0 | 0 |
| | 5 | 1 | 1 | 1 | 1 | 1 | 0 | 0 | 0 |
| | 6 | 1 | 1 | 1 | 1 | 1 | 1 | 0 | 0 |
| | 7 | 1 | 1 | 1 | 1 | 1 | 1 | 1 | 0 |
| | 8 | 1 | 1 | 1 | 1 | 1 | 1 | 1 | 1 |

Fig.6

| INPUT FRAME NUMBER | 0 | 1 | 2 | 3 | 4 | 5 | 6 | 7 |
|---|---|---|---|---|---|---|---|---|
| ODD NUMBER LINE FRAME NUMBER | 0 | 1 | 2 | 3 | 4 | 5 | 6 | 7 |
| EVEN NUMBER LINE FRAME NUMBER | 4 | 5 | 6 | 7 | 0 | 1 | 2 | 3 |

FIG.7

| | | ODD NUMBER PICTURE ELEMENT | | | | | | | | | | | | | | | | EVEN NUMBER PICTURE ELEMENT | | | | | | | | | | | | | | | |
|---|---|---|---|---|---|---|---|---|---|---|---|---|---|---|---|---|---|---|---|---|---|---|---|---|---|---|---|---|---|---|---|---|---|
| | | ODD NUMBER LINE FRAME NUMBER | | | | | | | | EVEN NUMBER LINE FRAME NUMBER | | | | | | | | ODD NUMBER LINE FRAME NUMBER | | | | | | | | EVEN NUMBER LINE FRAME NUMBER | | | | | | | |
| | | 0 | 1 | 2 | 3 | 4 | 5 | 6 | 7 | 0 | 1 | 2 | 3 | 4 | 5 | 6 | 7 | 0 | 1 | 2 | 3 | 4 | 5 | 6 | 7 | 0 | 1 | 2 | 3 | 4 | 5 | 6 | 7 |
| SCALE | 1 | 1 | 0 | 0 | 0 | 0 | 0 | 0 | 0 | 0 | 0 | 0 | 0 | 1 | 0 | 0 | 0 | 0 | 0 | 0 | 0 | 0 | 0 | 0 | 1 | 0 | 0 | 0 | 1 | 0 | 0 | 0 | 0 |
| | 2 | 1 | 1 | 0 | 0 | 0 | 0 | 0 | 0 | 0 | 0 | 0 | 1 | 1 | 0 | 0 | 0 | 0 | 0 | 0 | 0 | 0 | 0 | 1 | 1 | 0 | 0 | 0 | 1 | 1 | 0 | 0 | 0 |
| | 3 | 1 | 1 | 1 | 0 | 0 | 0 | 0 | 0 | 0 | 0 | 1 | 1 | 1 | 0 | 0 | 0 | 0 | 0 | 0 | 0 | 0 | 1 | 1 | 1 | 0 | 0 | 0 | 1 | 1 | 1 | 0 | 0 |
| | 4 | 1 | 1 | 1 | 1 | 0 | 0 | 0 | 0 | 0 | 1 | 1 | 1 | 1 | 0 | 0 | 0 | 0 | 0 | 0 | 0 | 1 | 1 | 1 | 1 | 0 | 0 | 0 | 1 | 1 | 1 | 1 | 0 |
| | 5 | 1 | 1 | 1 | 1 | 1 | 0 | 0 | 0 | 1 | 1 | 1 | 1 | 1 | 0 | 0 | 0 | 0 | 0 | 0 | 1 | 1 | 1 | 1 | 1 | 0 | 0 | 0 | 1 | 1 | 1 | 1 | 1 |
| | 6 | 1 | 1 | 1 | 1 | 1 | 1 | 0 | 0 | 1 | 1 | 1 | 1 | 1 | 0 | 0 | 1 | 0 | 0 | 1 | 1 | 1 | 1 | 1 | 1 | 1 | 0 | 0 | 1 | 1 | 1 | 1 | 1 |
| | 7 | 1 | 1 | 1 | 1 | 1 | 1 | 1 | 0 | 1 | 1 | 1 | 1 | 1 | 0 | 1 | 1 | 0 | 1 | 1 | 1 | 1 | 1 | 1 | 1 | 1 | 1 | 0 | 1 | 1 | 1 | 1 | 1 |
| | 8 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |

FIG.8 PRIOT ART

FIG.9 PRIOT ART

Fig.10 PRIOR ART

| | | | | | | | |
|---|---|---|---|---|---|---|---|
| SCALE 8 | 1 | 1 | 1 | 1 | 1 | 1 | 1 |
| SCALE 7 | 0 | 1 | 1 | 1 | 1 | 1 | 1 |
| SCALE 6 | 0 | 0 | 1 | 1 | 1 | 1 | 1 |
| SCALE 5 | 0 | 0 | 0 | 1 | 1 | 1 | 1 |
| SCALE 4 | 0 | 0 | 0 | 0 | 1 | 1 | 1 |
| SCALE 3 | 0 | 0 | 0 | 0 | 0 | 1 | 1 |
| SCALE 2 | 0 | 0 | 0 | 0 | 0 | 0 | 1 |
| SCALE 1 | 0 | 0 | 0 | 0 | 0 | 0 | 0 |

Fig.11 PRIOR ART

| | | FRAME NUMBER | | | | | | | |
|---|---|---|---|---|---|---|---|---|---|
| | | 7 | 6 | 5 | 4 | 3 | 2 | 1 | 0 |
| SCALE | 8 | F87 | F86 | F85 | F84 | F83 | F82 | F81 | F80 |
| | 7 | F77 | F76 | F75 | F74 | F73 | F72 | F71 | F70 |
| | 6 | F67 | F66 | F65 | F64 | F63 | F62 | F61 | F60 |
| | 5 | F57 | F56 | F55 | F54 | F53 | F52 | F51 | F50 |
| | 4 | F47 | F46 | F45 | F44 | F43 | F42 | F41 | F40 |
| | 3 | F37 | F36 | F35 | F34 | F33 | F32 | F31 | F30 |
| | 2 | F27 | F26 | F25 | F24 | F23 | F22 | F21 | F20 |
| | 1 | F17 | F16 | F15 | F14 | F13 | F12 | F11 | F10 |

Fig.12 PRIOR ART

| SCALE (FRAME NUMBER=1) | | | | | | | |
|---|---|---|---|---|---|---|---|
| 8 | 7 | 6 | 5 | 4 | 3 | 2 | 1 |
| F81 | F71 | F61 | F51 | F41 | F31 | F21 | F11 |

DISPLAY CONTROL DEVICE AND METHOD FOR GENERATING DISPLAY DATA TO DISPLAY IMAGES IN GRAY SCALE

BACKGROUND OF THE INVENTION

The present invention relates to a display control device for storing contents such as characters, line drawings or photographs on books, newspapers or magazines in an electronic, optical or magnetic recording medium, reading them out from the recording medium and displaying them in a flat type display device.

Recently, portable terminal devices with a display control device for storing character data or graphic data including gray scale such as characters, line drawings or photographs on books, newspapers or magazines in an electronic, optical or magnetic recording medium, reading them out from the recording medium and displaying them in a flat type display device such as a liquid crystal display device or the like are researched and developed. These kinds of portable terminal devices comprise a display control device for storing data recorded in a recording medium in a semiconductor memory such as Video RAM, reading out the stored data and display the data with gray scale images in a flat type display device.

For such a display device, color display devices using a color CRT are popular. Recently, however, to satisfy needs for miniaturization of devices, laptop type or notebook type small devices are being produced. For display devices of the laptop type or notebook type small devices, liquid crystal display devices or plasma display devices not CRT are used, because the former have advantages on lightening and thinning devices.

By the way, liquid crystal display devices or plasma display devices are used as monochrome display device, because developed color display devices of these types are so far expensive. Details of an art for converting color display data to monochrome display data on the liquid crystal display devices or plasma display devices are disclosed on the Japanese Patent Laid Open No. 299020 (1990) and the Japanese Patent Laid Open No. 85687 (1991).

To display images in gray scale on a liquid crystal display device, recorded data are converted to weighted bit patterns and stored in a Video RAM. For the weighting of 8 gray scale display, for example, the display data of a picture element is patterned by 3 bit length data such as scale number 1 [000], scale number 2 [001], . . . , scale number 8 [111]. When storing the scale data in the Video RAM, respective data areas such as second, first and 0-th bit planes of 3 bit length pattern are separately stored. A portable terminal device with a display control device for generating display data reads out the bit pattern stored in the Video RAM and generates scale display data.

The scale display data for a liquid crystal display is generated by decimating the data read out from the Video RAM. For the method of data decimation, it is possible to decimate frames in point of time from the read out data, then convert the result to display data. Displaying on the liquid crystal display device is performed by conducting a display picture element ON/OFF. The frame decimation is to control this ON/OFF operation in point of time.

FIG. 10 shows an example of 8 gray scale display of a picture element. In this case, 7 frames from frame number 1 to frame number 7 form a display cycle. For example, scale number 3 is displayed on a liquid crystal display device when the scale display data [0000011] is sent in point of time to the liquid crystal display device. Namely, frame number 1 to frame number 5 at the picture element position are OFF and frame number 6 and frame number 7 at the picture element position are ON.

In a display device using a liquid crystal display device, an interference between frequency of a fluorescent lamp and frequency of display data of the liquid crystal display device causes flickering. In addition, in a display control device controlling gray scale display of the liquid crystal display device, flickering of screen may occur due to the drop of frame frequency of display data or arrangement of display data. The reason is that eyes of user recognize ON/OFF of the display picture element.

For example, a case of outputting the same scale display data in an area is considered. In this case, if the above-mentioned scale number 3 display data is output, all picture elements in this area are simultaneously conducted ON/OFF in the same cycle. Eyes of user recognize this ON/OFF, thus flickering of screen is recognized. To decrease this flickering, the pattern of display data may be changed. For example, the pattern [0000011] of the above-mentioned display data is changed to [0010001] so as to increase frame frequency of display data. Then, the pattern of display data is changed for each line and each picture element. In the horizontal direction display data, the pattern of the display data is changed for each picture, for example, the odd number picture element on a display screen is changed to [0010001] and the even number picture element on a display screen is changed to [1000100]. In the same way as this, the pattern of vertical direction display data is also changed. In the vertical direction, the pattern of the display data is changed according to the line number.

FIG. 8 shows a construction of a conventional display control device 20'. As shown in FIG. 8, the conventional display control device 20' is provided between a Video RAM 22 for storing weighted bit data for gray scale display and a flat type display device 24 (a liquid crystal display device, in the present embodiment). It reads out data stored in the Video RAM, conducts decimation and outputs the result to the liquid crystal display device 24.

The display control device 20' comprises a first to third latch circuits 26, 27 and 28, a scale data generation section 30, an address generation section 32, a display control section 34, a control section 36', a scale table register section 38, decimation section 40' and a display data latch section 42. Display data that was output from the liquid crystal display device 24 is data decimated based a line number, a line discriminant signal and a picture element discriminant signal. The data to be decimated is stored in the scale table register section 38 of which construction is explained later. The data is read out from the Video RAM 22 and converted to scale data. This data selects a register in which an arbitrary value is written in the scale table register section 38. Based on this value, the data is decimated.

The Video RAM 22 is a semiconductor memory in which the data that has been weighted and separated for each bit plane is stored for each plane. In the present embodiment, three bit planes, that is, plane 3, plane 2 and plane 1 are provided. The first to third latch circuits 26, 27 and 28 respectively read out data of plane 3 to plane 1, and latch them. The scale data generation section 30 generates scale data for each plane from data latched in the latch circuits 26 to 28.

The address generation section 32 generates a read address of the Video RAM 22. The display control section 34 conducts reading from the Video RAM 22, control of the control section 36' and control of the liquid crystal display device 24. The control section 36' outputs control signals for decimation such as an odd/even number picture element discriminant signal, an odd/even line discriminant signal and a frame number to the decimation section 401. The scale table register section 38 connected with the CPU bus comprises four units of register of 8 bit length in which an arbitrary value can be written.

The decimation section 40' decimates register set values supplied from the scale table register 38, based on the frame number supplied from the control section 36', the odd/even number line discriminant signal, the odd/even number picture element discriminant signal and the scale data supplied from the scale data generation section 30, and outputs display data to the display data latch section 42. The display data latch section 42 latches display data output from the decimation section 40', and outputs the data to the liquid crystal display device 24 at a timing of a control signal that is output from the display control section 34. The liquid crystal display device 24 receives the display data and conducts ON/OFF of the display picture element of the liquid crystal panel at the timing of the control signal supplied from the display control signal 34.

FIG. 9 shows detailed constructions of the scale table register section 38 and the decimation section 40' that are shown in FIG. 8. Here, the example where 8 picture elements of the display screen are processed as a unit is explained.

The scale table register section 38 comprises a first to fourth scale table registers 51 to 54. The decimation section 40' comprises a first to eighth decimation units 61' to 68'. A signal writing data to the first to fourth scale registers 51 to 54 is supplied from a CPU (not shown).

The first to eighth decimation units 61' to 68' have the same construction, so only a detailed construction of the first decimation unit 61' is shown in this figure. The first decimation unit 61' comprises a first to fourth frame decimation sections 71 to 74, a first to fourth scale multiplexer sections 76 to 79, a first and second line decimation sections 81 and 82, and a picture element decimation section 84.

The first scale table register 51 is a register in which a scale table of display picture element of which line number is odd and picture element number is odd is stored. The second scale table register 52 is a register in which a scale table of display picture element of which line number is odd and picture elements number is even is stored. The third scale table register 53 is a register in which a scale table of display picture element of which line number is even and picture elements number is odd is stored. The fourth scale table register 54 is a register in which a scale table of display picture element of which line number is even and picture elements number is even is stored.

Based on a frame number as a selection signal, the first to fourth frame decimation sections 71 to 74 respectively select 8 scale table data of the same frame number from data of 8 scale 8 bit length (7 bits for frames and 1 bit for dummy) supplied from the first to fourth scale table registers 51 to 54. The selected scale table data is a data of 8 bit length (8 scale×1 frame). Each of the first to fourth frame decimation sections 71 to 74 comprises 8 multiplexers, construction of each of them is of 8:1.

Based on a scale data as a selection signal, the first to fourth multiplexer sections 76 to 79 respectively select a data of 1 scale and 1 frame from scale table data of 8 scale 1 bit length (1 bit frame) supplied from the first to fourth frame decimation sections 71 to 74. The selected data is a data of 1 bit length (1 scale×1 frame). Each of the first to fourth multiplexer sections 76 to 79 comprises a multiplexer of 8:1.

Based on an odd/even number line discriminant signal for discriminating an odd number line and even number line on the display screen as a selection signal, the first and second line decimation sections 81 and 82 select data supplied from the first to fourth scale multiplexer sections 76 to 79. The data supplied from the first and third scale multiplexer sections 76 and 78 are the data decimated in the first and third scale table registers 51 and 53 which are respectively displayed upon odd number line/odd number picture element on the display screen and even number line/odd number picture element on display screen. The data supplied from the second and fourth scale multiplexer sections 77 and 79 are the data decimated in the second and fourth scale table registers 52 and 54 which are respectively displayed upon odd number line/even number picture element on the display screen and even number line/even number picture element on the display screen. The second line decimation section 82 selects a data to be displayed when the number of the picture element of the display screen is even. The selected data is of 1 bit length. Each of the first and second line decimation sections 81 and 82 comprises a multiplexer of 2:1.

Based on an odd/even number picture element discriminant signal for discriminating an odd number picture element and an even number picture element on the display screen as a selection signal, the picture element decimation section 84 selects a 1 bit length display data from odd picture element display data supplied by the first line decimation section 81 and even number picture element display data supplied by the second line decimation section 82. The selected data is of 1 bit length, the picture element decimation section 84 consists of a multiplexer of 2:1.

Returning to FIG. 8, the data read out from the Video RAM 22 is latched for each plane in the latch circuits 26, 27 and 28. The data of which each plane data is latched in the first to third latch circuits 26, 27 and 28 are converted to a scale data of which most significant data is plane 3 data and least significant data is plane 1 data. The converted scale data is output to the decimation section 40'. Here, each plane data is of 8 bit length because 8 picture elements of the display screen is a processing unit. The scale data generation section 30 outputs 8 kinds of scale data of 3 bit length respectively, that is, totally 24 bits data.

As FIG. 9 shows, each of the first to eighth decimation units 61' to 68' is supplied by a 3 bit length scale data, a control signal output from the display control section 34 and totally 5 bit data, that is, a 1 bit length odd/even number picture element discriminant signal for discriminating odd number picture element and even number picture element of the display screen, a 1 bit length odd/even number line discriminant signal for discriminating odd number line and even number line of the display screen and 3 bit length frame number. Each of the first to eighth decimation units 61' to 68' conducts decimation to output 1 bit length display data, as mentioned above. The total 8 bits display data is latched in the display data latch section 42 and output to the liquid crystal display device 24 at a display timing controlled by the display control section 34.

As shown in FIG. 11, each data of the first to fourth scale table registers 51 to 54 is of 8 scale 8 bit length. In F10 to F87, display data are stored. The first to fourth frame decimation sections 71 to 74 respectively frame decimates data of the first to fourth scale table registers 51 to 54. The first to fourth scale multiplexer sections 76 to 79 respectively select data from data supplied by the first to fourth frame decimation sections 71 to 74, using scale data. The results are output to the first and second line decimation sections 81 and 82.

FIG. 12 shows an example of frame decimation when the frame number is 1 and data construction selected from the scale table register. The data selected in the first to fourth scale multiplexer sections 76 to 79 is a data stored in F31, for example.

When displaying images in gray scale data on the screen of the liquid crystal display device 24, using set values of the scale table registers 51 to 54 that are rewritten by a software, the above-mentioned conventional display control device 20' controls ON/OFF of the picture elements of the liquid crystal display device 24. In addition, to reduce flickering, it recognizes display positions and frame numbers of odd number picture elements, even number picture elements, odd number lines and even number lines, and controls ON/OFF of the picture elements of the liquid crystal display device 24.

In such a conventional display device, there are some problems such as necessity of set data in the scale table registers 51 to 54 even if there is no need to control ON/OFF of the picture elements of the liquid crystal display device 24 and increasing of circuit scale of the scale table register section 38 because of the register construction.

SUMMARY OF THE INVENTION

It is an object of the present invention to provide an art enabling to generate display data without using registers for ON/OFF control of a flat type display device.

It is another object of the present invention to provide an art enabling to reduce the circuit size by using size comparators for ON/OFF control of the flat type display device.

The present invention is achieved by a display control device for controlling display by generating display data to display images in gray scale from scale data representing scale number of a predetermined display picture element and each frame data representing frames necessary for displaying images in gray scale in a flat type display device, the display control device comprising display data generation means for generating display data of the display picture element by sequentially comparing scale number representing the scale data and each frame number representing the frame data.

Furthermore, the present invention is achieved by a method for generating display data to display images in gray scale in a flat type display device comprising steps of: generating display data of the display picture element by sequentially comparing scale number of a display picture element and each frame number of frames necessary to display images in gray scale.

The present invention features to generate display data by comparing a frame number and a scale number.

As a result, it enables to generate display data using a small size circuitry construction.

In addition, the present invention, that is, to compare a frame number and a scale number using a conversion table for outputting different frame numbers for respective lines of a display screen, not using set values with a software, enables to reduce flickering of the liquid crystal display device.

BRIEF DESCRIPTION OF THE DRAWINGS

This and other objects, features and advantages of the present invention will become more apparent upon a reading of the following detailed description and drawings, in which:

FIG. 3 is a truth table for explaining the operation of a size comparator configuring the display data generation section shown in FIG. 2 and FIG. 4;

FIG. 4 is a truth table for explaining the operation of the display data generation section shown in FIG. 2;

FIG. 6 is a truth table for explaining the operation of the frame number modification table in the display data generation section shown in FIG. 5;

FIG. 7 is a truth table for explaining the operation of the display data generation section shown in FIG. 5;

FIG. 10 is a drawing showing a relation between scale display and display data;

FIG. 11 is a data format table for explaining data configuration of the scale table in FIG. 9; and FIG. 12 is a data format table for explaining data configuration that is input to the frame decimation section in FIG. 9.

DESCRIPTION OF THE PREFERRED EMBODIMENTS

The first embodiment of the present invention is explained.

Figure 1:
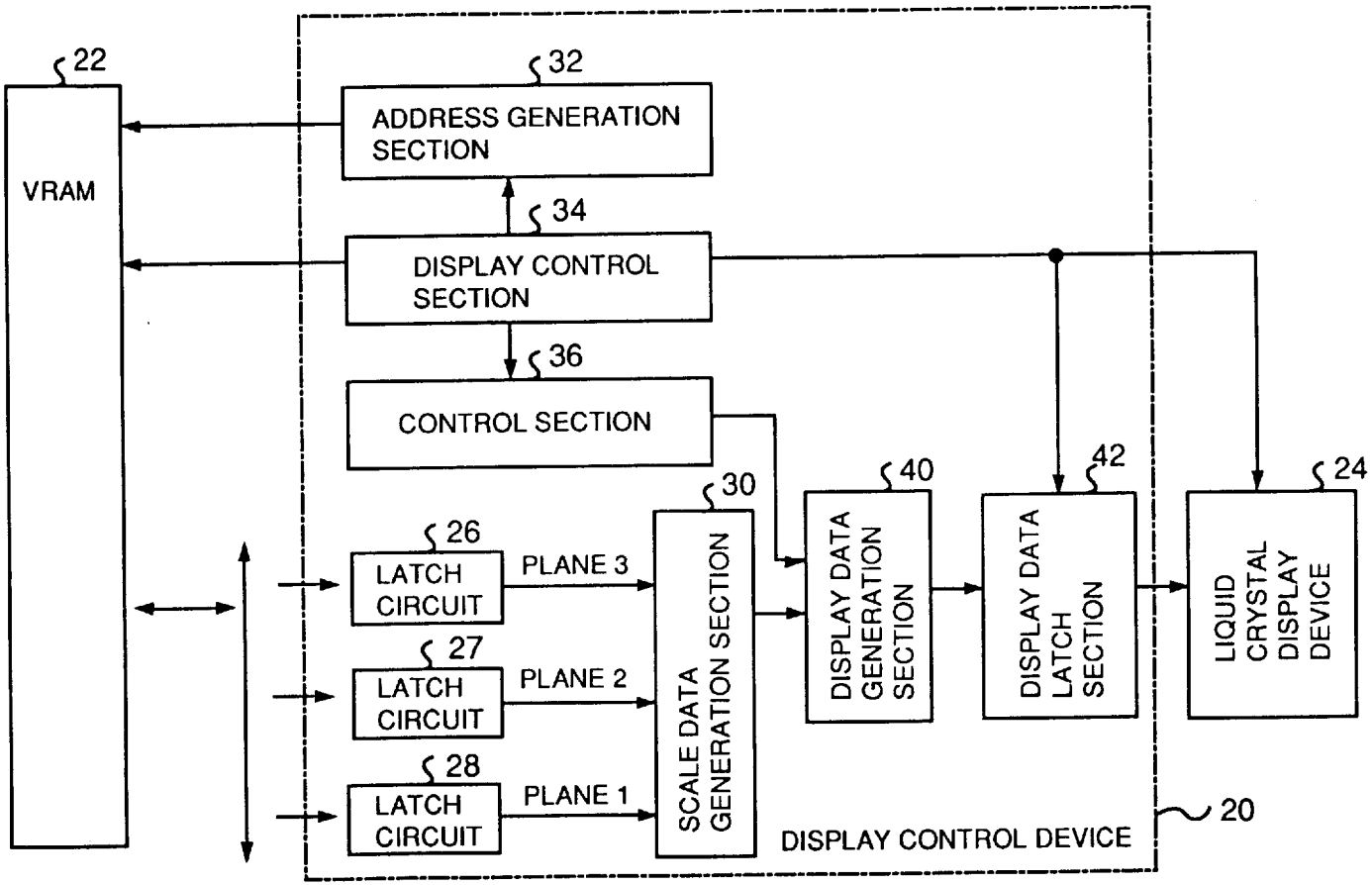
FIG. 1 is a block diagram of the first embodiment of the display control device of the present invention.

FIG. 1 is a block diagram of a display control device 20 of the first embodiment.

The display control device 20 comprises a first to third latch circuits 26, 27 and 28, a scale data generation section 30, an address generation section 32, a display control section 34, a control section 36, a display data generation section 40 and a display data latch section 42.

In a Video RAM 22, weighted data are stored, being separated for each bit plane.

The latch circuits 26 to 28 are respectively called as plane 3 latch circuit, plane 2 latch circuit and plane 1 latch circuit. They latch data read out from the Video RAM 22. The latch circuits 26 to 28 respectively latch 8 bit length data.

The scale data generation section 30 generates, for each plane, 8 picture element scale data from data latched in the latch circuits 26 to 28. Each scale data is of 3 bit length data, [000] for scale number 1, [001] for scale number 2, [010] for scale number 3, etc., for example.

The address generation section 32 generates read addresses of the Video RAM 22.

The display control section 34 reads out data from the Video RAM 22 and controls the liquid crystal display device 24.

The control section 36 outputs frame data. The frame data is of 3 bit length data signal, [000] for frame number 0, [001] for frame number 1, [010] for frame number 2, or the like.

The display data generation section 40 generates display data to be output to the liquid crystal display device 24 using the scale data and the frame data.

The display data latch section 42 latches display data supplied from the display data generation section 40 and outputs data to the liquid crystal display device 24 at a timing of a control signal supplied from the display control section 34.

The liquid crystal display device 24 conducts ON/OFF of the display elements of the liquid crystal panel using the input display data at the timing of the control signal supplied from the display control section 34.

Figure 2:
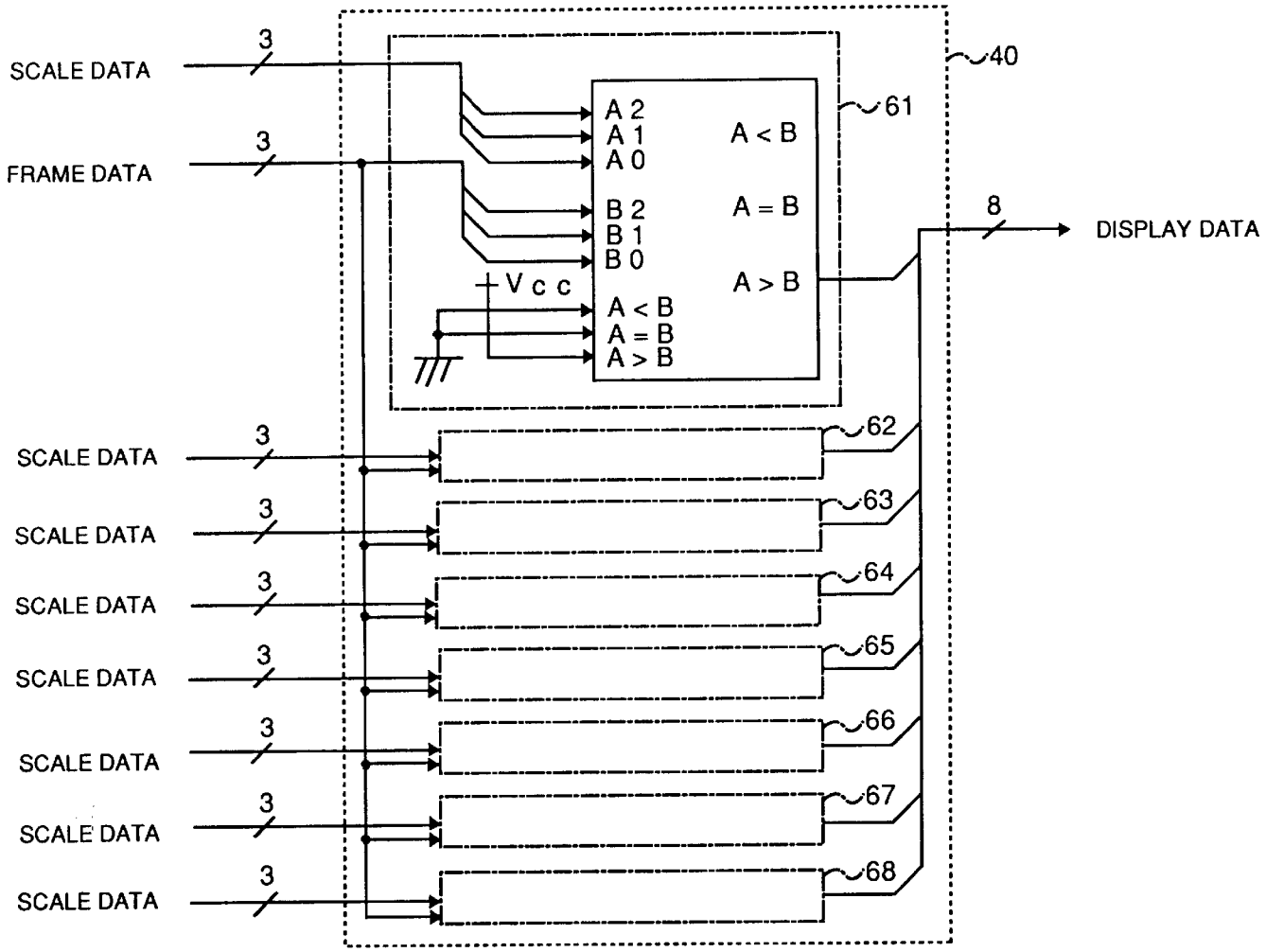
FIG. 2 is a block diagram of a sample configuration of a display data generation section of the display control device shown in FIG. 1.

FIG. 2 shows an example of the display data generation section 40 shown in FIG. 1.

In this example, the display data generation section 40 shown in FIG. 2 processes 8 picture elements among elements of a display screen as a unit. The display data generation section comprises a first to eighth display data generation units 61 to 68, each of them is of 3 bit length.

As shown in FIG. 2, each of the first to eighth display data generation units 61 to 68 comprises a size comparator. Each size comparator is supplied by 3 bit length scale data representing scale number of one picture element of the display element from the scale data generation section 30 and 3 bit length frame data from the control section 36. Then, each size comparator compares a scale number and a frame number, and outputs 1 bit length display data as a result. As 8 picture elements are processed as a processing unit in the present embodiment, the display data generation section 40 outputs 8 bit length display data. Like this example of 8 gray scale displaying, one scale data (one scale number) and 8 frame numbers from 0 to 7 are sequentially compared and display data is output.

FIG. 3 shows a truth table of signals output from the size comparators of the first to eighth display data generation units 61 to 68. An output from each size comparator is a signal value output from an output terminal of A>B. For example, if comparing scale number 3 of which scale data is [010] and frame number 5 of which frame data is [101], A2<B2, A1>B1 and A0<B0, since A2=0, A1=1, A0=0, B2=1, B1=0 and B0=1. Therefore, [0] is output from the A>B, since A2<B2.

Returning to FIG. 1, an operation of the display control device of the present invention is explained.

The data read out from the Video RAM 22 is latched for each plane in the first to third latch circuits 26, 27 and 28. The scale data generation section 30 converts each plane data latched in the first to third latch circuits 26, 27 and 28 to 3 bit length 8 picture element scale data so as the plane 3 data may become a most significant data and the plane 1 data may become least significant data. The converted scale data is output to the display data generation section 40.

Each bit plane of the 8 picture element scale data is separately input to the first to eighth display data generation units 61 to 68. The first to eighth display data generation units 61 to 68 compares the scale number and frame number supplied from the control section 36, outputs display data according to the truth table shown in the above-mentioned FIG. 4. The display data generation section 40 compiles outputs from the first to eighth display data generation units 61 to 68 and outputs 8 bit length display data.

This 8 bit length display data is latched in the display data latch section 42 and output to the liquid crystal display device 24 at a timing of a control signal output by the display control section 34.

Next, the second embodiment is explained.

Figure 5:
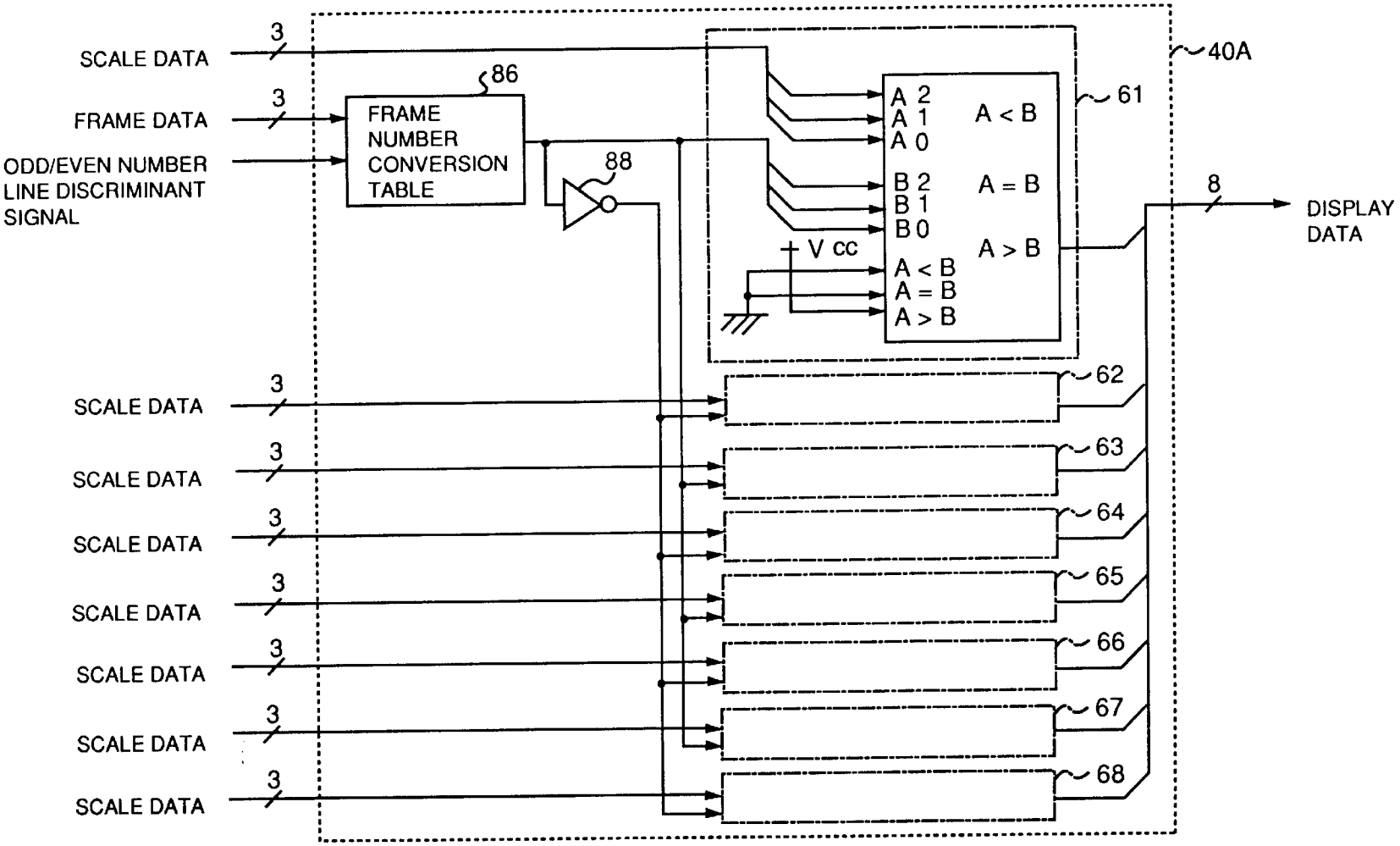
FIG. 5 is a block diagram of construction of the display control device of the second embodiment.
Figure 8:
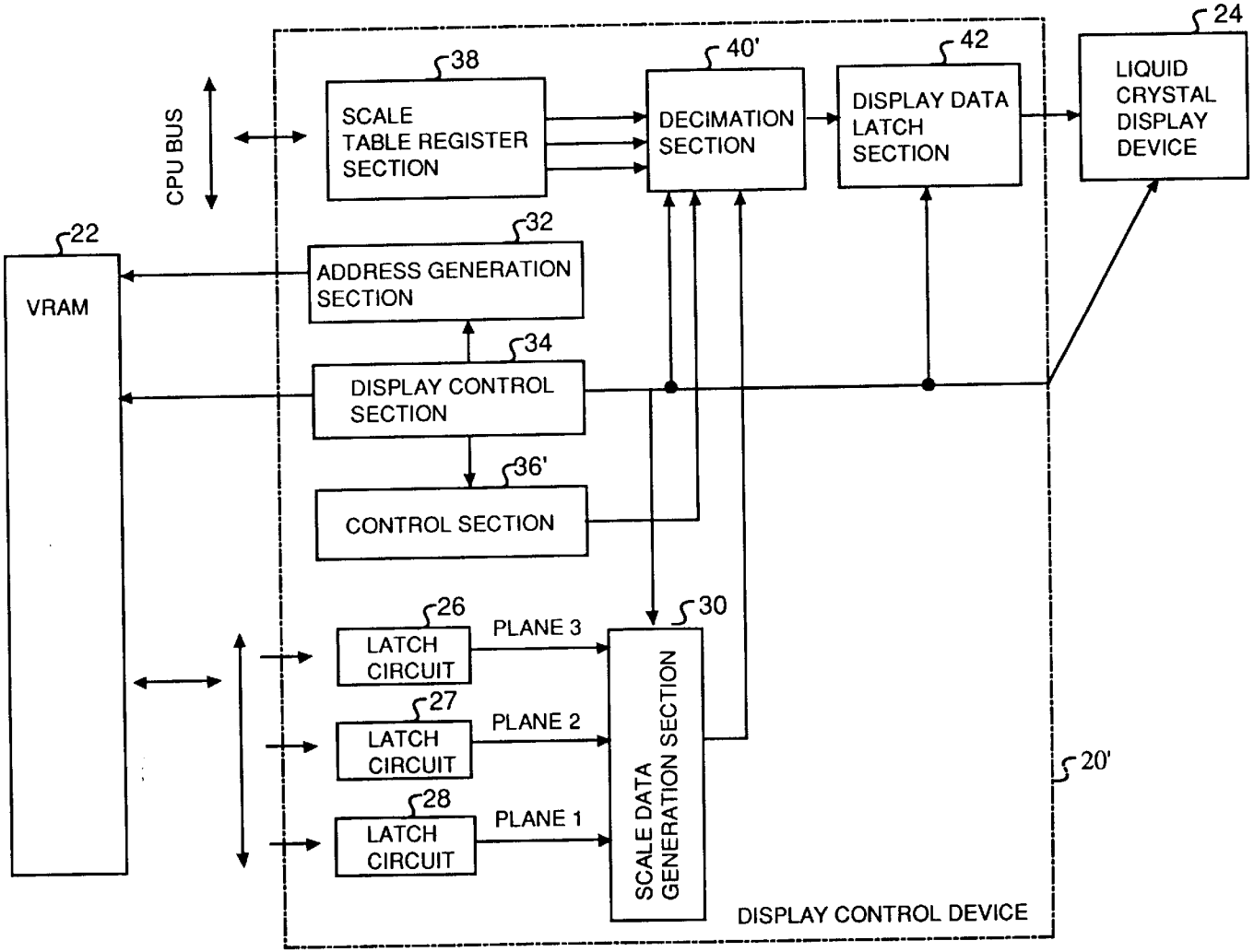
FIG. 8 is a block diagram of construction of a conventional display control device.
Figure 9:
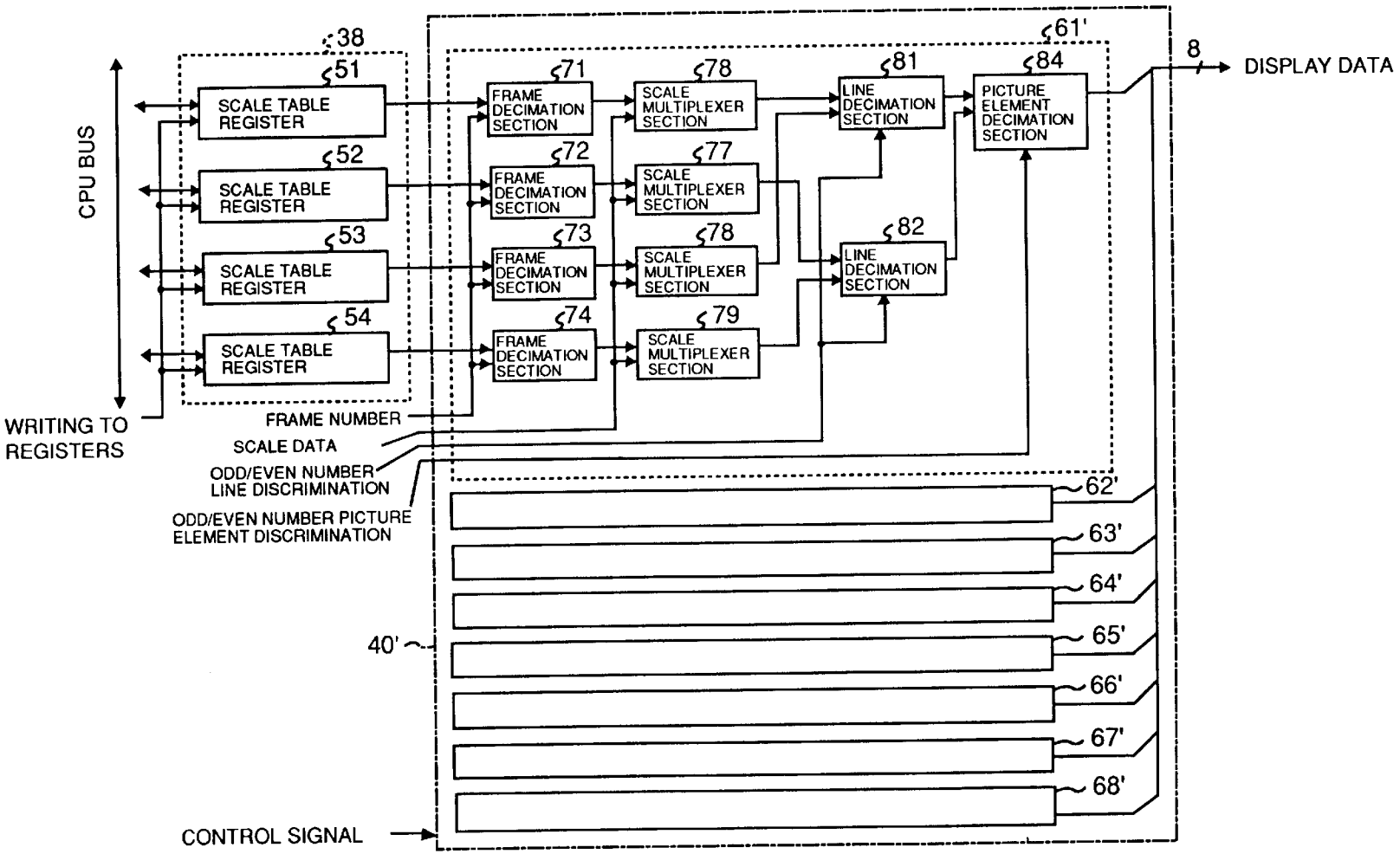
FIG. 9 is a block diagram of a sample of construction of a scale table register section and a decimation section of the display control section shown in FIG. 8.

FIG. 5 shows the second embodiment of the display data generation section shown in FIG. 1. Here, the display data generation section is marked by a reference code, 40A. This display data generation section 40A also processes 8 picture elements as a processing unit in this embodiment.

The display data generation section 40A comprises the first to eighth decimation units 61 to 68, a frame number conversion table 86 and an inverter 88.

The control section 36 outputs an odd/even number line discriminant signal for discriminating an odd number line and even number line, frame data and so on. Here, the odd/even number line discriminant signal is of 1 bit length data signal, [1] for an odd number line or [0] for an even number line.

The control section 36 supplies total 4 bit data of an odd/even number line discriminant signal for discriminating odd number line and even number line on a display screen of 1 bit length and 3 bit length frame data to the frame number conversion table 86. According to the conversion rule shown in FIG. 6, the frame number conversion table 86 converts the received frame number data to 3 bit length data that are different in an odd number line and an even number line and outputs a result.

For example, if the frame number is 0 (description in form of 3 bit length frame number data is [000]) and an odd/even number line discriminant signal indicates an odd line (description in form of 1 bit length odd/even number line discriminant signal is [1]), the converted frame number 0 (description in form of 3 bit length frame number data is [000]) is output. Similarly to this, if the frame number is 0 (description in form of 3 bit length frame number data is [000]) and an odd/even number line discriminant signal indicates an even line (description in form of 1 bit length odd/even number line discriminant signal is [0]), the converted frame number 4 (description in form of 3 bit length frame number data is [100]) is output.

The inverter 88 inverts frame number data from the frame number conversion table 86 and output a result. Here, "invert" means to invert each bit value in 3 bits. For example, if inverting 3 bit length data [101], it becomes a 3 bit length data [010].

Each of the first, third, fifth and seventh display data generation units 61, 63, 65 and 67 generates display data of odd number picture element of a display screen. The scale data generation section 30 supplies 3 bit length scale data representing scale number of one picture element of the display screen and 3 bit length frame data representing frame number converted according to the frame number conversion table 86 to the display data generation units 61, 63, 65 and 67.

Each of the second, fourth, sixth and eighth display data generation units 62, 64, 66 and 68 generates display data of even number picture element of a display screen. The scale data generation section 30 supplies 3 bit length scale data representing scale number of one picture element of the display screen and 3 bit length frame data representing frame number inverted by the inverter 88 to the second, fourth, sixth and eighth display data generation units 62, 64, 66 and 68. Here, the comparators used in the display data generation units 61 to 68 are the same as comparators used in the first embodiment.

FIG. 7 shows a truth table of the display data section 40A shown in FIG. 5.

Next, an operation of the second embodiment is explained.

The data read out from the Video RAM 22 is latched for each plane in the first to third latch circuits 26, 27 and 28. The scale data generation section 30 converts each plane data latched in the first to third latch circuits 26, 27 and 28 to 3 bit length 8 picture element scale data so as the plane 3 data may become a most significant data and the plane 1 data may become least significant data. The converted scale data is output to the display data generation section 40.

The control section 36 outputs an odd/even number line discriminant signal for discriminating a line on which 8 picture elements are aligned and frame number data.

The display data generation section 40A is input by 8 scale data, an odd/even number line discriminant signal and frame number data.

Each scale data is input to each of the first to eighth display data generation units 61 to 68.

The frame data and the odd/even number line discriminant signal are input to the frame number conversion table 86.

The frame number conversion table 86 converts frame number according to a conversion rule shown in FIG. 6. If the odd/even number line discriminant signal indicates even number and the frame data indicates frame number 4, it convert the frame number to 0 and outputs it, for example. Namely, the frame data [100] is converted to [000] and output.

The converted frame number data is output to the inverter 88 and the display data generation units 61, 63, 65 and 67.

The inverter 88 additionally inverts the converted frame number data. Here, the frame number data [000] is inverted to [111], for example, and it outputs the inverted data to the display data generation units 62, 64, 66 and 68.

The first to eighth display data generation units 61 to 68 compares a scale number and a frame number from the control section 36 and outputs display data according to the truth table shown in above-mentioned FIG. 4. The display data generation section 40A outputs 8 bit length display data according to the truth table in FIG. 7.

The 8 bit length display data is latched in the display data latch section 42 and output to the liquid crystal display device 24 at a timing of a control signal output from the display control section 34.

It is not necessary to say that the present invention explained in the embodiment is not limited within the embodiment. In addition, it can be modified or changed within the limitation of the present invention. For example, a liquid crystal display device is explained in the embodiment, it can be replaced with any flat type display device such as a plasma display device.

Moreover, the display data generation section processes 8 picture elements of a display screen as a processing unit in the embodiment. However, it is possible to use $2^n$ (n is an integer of $n \geqq 0$) picture elements of a display screen such as 16 picture elements as a processing unit.

Furthermore, it is possible to use frame number data output from the inverter 88 for odd number picture element and frame number data output from the frame number conversion table 86 for even number picture element.

What is claimed is:

1. A display control device for controlling a display by generating data to display images in gray scale from scale data representing a scale number of a predetermined display picture element and each frame data representing frames necessary for displaying images in gray scale in a flat type display device, said display control device comprising:

display data of said display picture element by comparing a scale number representing said scale data and each frame number representing said frame data, in sequential frame number order;

a plurality of latch circuits for latching data read out from a video RAM in which bit data weighted for displaying images in gray scale are stored;

scale data generation means for generating scale data representing frame number of a predetermined display picture element from said bit data latched in said latch circuit;

means for outputting each frame data representing frame number of said display picture element;

control means for outputting a timing signal;

display data latch means for latching display data output from said display data generation means and outputting said display data to said flat type display device according to said timing signal; and display generation means, including a comparator for comparing said scale number and each said frame number of said display picture element, for outputting display data to turn said display picture element ON when said scale number is larger than said frame numbers, OFF when said scale number is equal to said frame number, and OFF when said scale number is smaller than said frame number.

2. The display control device of claim 1, wherein said flat type display device is a liquid crystal display device.

3. The display control device of claim 1, wherein said flat type display device is a plasma display device.

4. The display control device of claim 1, further comprising scale data generation means for generating scale data of a plurality of display picture elements, and wherein said display data generation means processes a plurality of display picture elements as a processing unit and includes a plurality of comparators, each of said comparators compares one of said pixel elements scale number and said each frame number.

5. The display control device of claim 4, wherein, each of said comparators compares said scale number and said each frame number and outputs display data to turn said display picture element ON when said scale number is larger than said frame number, OFF when said scale number is equal to said frame number, and OFF when said scale number is smaller than said frame number.

6. The display control device of claim 4, further comprising:

said scale data generation section for generating $2^n$ (n is an integer of $n \geqq 0$) scale data of $2^n$ display picture elements; and said display data generation means including $2^n$ units of said comparators for processing $2^n$ display picture elements as a processing unit.

7. The display control device of claim 1, further comprising:

means for outputting a discriminant signal for discriminating an odd number line and an even number line on a display screen of said flat type display device;

first frame data conversion means for converting contents of a frame data so that a frame number of said frame data when a picture element corresponding to said frame data is on an odd number line is different from a frame number of said frame data when said picture element corresponding to said frame data is on an even number line, based on said discriminant signal;

second frame data conversion means for converting said converted frame data to another different frame data so that each bit of said converted frame is inverted; and a scale data generation section for generating a plurality of scale data; wherein said display data generation means comprises:

a plurality of first comparators for comparing each frame number of said frame data converted in said first frame data conversion means and scale number of said scale data;

and a plurality of second comparators for comparing each frame number of said frame data converted in said second frame data conversion means and scale number of said scale data.

8. A display control device for controlling a display by generating display data to display images in a gray scale from scale data representing a scale number of a predetermined display picture element and each frame data representing frames necessary for displaying images in gray scale in a flat type display device, said display control device comprising display data generation means for generating display data of said display picture element by sequentially comparing a scale number representing said scale data and each frame number representing said frame data, further comprising means for outputting a discriminant signal for discriminating an odd number line and an even number line on a display screen of said flat type display device;

first frame data conversion means for converting contents of a frame data so that a frame number of said frame data when a picture element corresponding to said frame data is on an odd number line is different from a frame number of said frame data when said picture element corresponding to said frame data is on an even number line, based on said discriminant signal;

second frame data conversion means for converting said converted frame data to another different frame data so that each bit of said converted frame data is inverted; and a scale data generation section for generating a plurality of scale data; wherein said display data generation means comprises:

a plurality of first comparators for comparing each frame number of said frame data converted in said first frame data conversion means and scale number of said scale data;

and a plurality of second comparators for comparing each frame number of said frame data converted in said second frame data conversion means and scale number of said scale data;

further comprising said first comparators and said second comparators, each of said comparators compares said scale number and said each frame number, and outputs display data to turn said display picture element ON when said scale number is larger than said frame number, OFF when said scale number is equal to said frame number, and OFF when said scale number is smaller than said frame number.

9. A display control device for controlling a display by generating display data to display images in a gray scale from scale data representing a scale number of a predetermined display picture element and each frame data representing frames necessary for displaying images in gray scale in a flat type display device, said display control device comprising display data generation means for generating display data of said display picture element by sequentially comparing a scale number representing said scale data and each frame number representing said frame data, further comprising means for outputting a discriminant signal for discriminating an odd number line and an even number line on a display screen of said flat type display device;

first frame data conversion means for converting contents of a frame data so that a frame number of said frame data when a picture element corresponding to said frame data is on an odd number line is different from a frame number of said frame data when said picture element corresponding to said frame data is on an even number line, based on said discriminant signal;

second frame data conversion means for converting said converted frame data to another different frame data so that each bit of said converted frame data is inverted; and a scale data generation section for generating a plurality of scale data; wherein said display data generation means comprises:

a plurality of first comparators for comparing each frame number of said frame data converted in said first frame data conversion means and scale number of said scale data;

and a plurality of second comparators for comparing each frame number of said frame data converted in said second frame data conversion means and scale number of said scale data;

wherein said second frame data conversion means comprises an inverter for inverting said frame data.

10. A display control device for controlling a display by generating display data to display images in a gray scale from scale data representing a scale number of a predetermined display picture element and each frame data representing frames necessary for displaying images in gray scale in a flat type display device, said display control device comprising display data generation means for generating display data of said display picture element by sequentially comparing a scale number representing said scale data and each frame number representing said frame data, further comprising means for outputting a discriminant signal for discriminating an odd number line and an even number line on a display screen of said flat type display device;

first frame data conversion means for converting contents of a frame data so that a frame number of said frame data when a picture element corresponding to said frame data is on an odd number line is different from a frame number of said frame data when said picture element corresponding to said frame data is on an even number line, based on said discriminant signal;

second frame data conversion means for converting said converted frame data to another different frame data so that each bit of said converted frame data is inverted; and a scale data generation section for generating a plurality of scale data; wherein said display data generation means comprises:

a plurality of first comparators for comparing each frame number of said frame data converted in said first frame data conversion means and scale number of said scale data;

and a plurality of second comparators for comparing each frame number of said frame data converted in said second frame data conversion means and scale number of said scale data;

wherein said scale generation section generates $2^{(n+1)}$ (n is an integer of $n \geqq 0$) scale data of $2^{(n+1)}$ display picture elements.

11. The display control device of claim 10, wherein said display data generation means processes $2^{(n+1)}$ display picture elements as a processing unit, and said display generation means includes $2^n$ units of said first comparators for odd picture elements and $2^n$ units of said second comparators for even picture elements.

12. The display control device of claim 10, further comprising:

said display control device for processing $2^{(n+1)}$ display picture elements as a processing unit by having $2^n$ units of said first comparators for odd number line picture elements and $2^n$ units of said second comparators for even number line picture elements.

13. A display control device for generating display data to display images in gray scale in a flat type display device and controlling display comprising:

a plurality of latch circuits for latching data read out from a video RAM in which bit data weighted for displaying images in gray scale in a flat type display device are stored;

scale data generation means for generating scale data representing a scale number for each of a plurality of display picture elements based on said data latched in said latch circuits;

frame data output means for outputting each frame data representing frame numbers of said display picture elements;

a plurality of comparators, each of said comparators compares, said scale number and said each frame number, in sequential frame number order, and outputs display data to turn said display picture element ON when said scale number is larger than said frame number, OFF when said scale number is equal to said frame number, and OFF when said scale number is smaller than said frame number;

control means for outputting a timing signal;

display data latch means for latching said display data output from said plurality of comparators and outputting said display data to said flat type display device according to said timing signal;

wherein said scale data generation means further comprises $2^n$ (n is an integer of $n \geqq 0$) units of comparators for generating $2^n$ scale data, and wherein said display control device processes $2^n$ display picture elements as a processing unit.

14. A display control device for generating display data to display images in gray scale in a flat type display device and controlling display comprising:

a plurality of latch circuits for latching data read out from a video RAM in which bit data weighted for displaying images in gray scale in a flat type display device are stored;

scale data generation means for generating scale data representing a scale number for each of a plurality of display picture elements based on said data latched in said latch circuits;

frame data output means for outputting each frame data representing frame numbers of said display picture elements;

means for outputting a discriminant signal for discriminating an odd number line and an even number line on a display screen of said flat type display device;

first frame data conversion means for converting contents of a frame data so that a frame number of said frame data when a picture element corresponding to said frame data is on an odd number line is different from a frame number of said frame data when said picture element corresponding to said frame data is on an even number line, based on said discriminant signal;

second frame data conversion means for converting said frame data converted with said first frame data conversion means so that every bit of said converted frame data is inverted;

a plurality of first comparators, each of said first comparators sequentially compares said scale number and each said frame number of said converted frame data in said first frame data conversion means, and outputs display data to turn said display picture element ON when said scale number is larger than said frame number, OFF when said scale number and OFF when said scale number is smaller than said frame number;

a plurality of second comparators, each of said second comparators sequentially compares said scale number and each frame number of said frame data converted in said second frame data conversion means, and outputs display data to turn said display picture element ON when said scale number is larger than said frame number, OFF when said scale number is equal to said frame number, and OFF when said scale number is smaller than said frame number;

control means for outputting a timing signal; and display data latch means for latching said display data output from said first comparators and said second comparators and outputting said display data to said flat type display device according to said timing signal.

15. A method for generating display data to display images in gray scale in a flat type display device comprising steps of:

generating display data of said display picture element by comparing a scale number of a display picture element and each frame number, in sequential frame number order, of frames necessary to display images in gray scale;

generating a discriminant signal for discriminating an odd number line and an even number line on a display screen of said flat type display device;

first frame number conversion step of converting contents of a frame data so that a frame number of said frame data when a picture element corresponding to said frame data is on an odd number line is different from a frame number of said frame data when said picture element corresponding to said frame data is on an even number line, based on said discriminant signal;

second frame number conversion step of further converting said converted frame number to another different frame number; and generating a plurality of first scale numbers and a plurality of second scale numbers;

wherein said display data generation step comprises steps of:

comparing a frame number converted in said first frame number conversion step and said first scale number; and comparing a frame number converted in said second frame number conversion step and said second scale number.

16. The method of claim 15, wherein said method for generating said display data comprises the steps of:

(a) comparing said scale number and said frame number, outputting data to turn said display picture element ON when said scale number is larger than said frame number, OFF when said scale number is equal to said frame number, and OFF when said scale number is smaller than said frame number; and (b) sequentially applying said step (a) to each frame number of said display picture element.

17. The method of claim 15, further comprising a step of generating scale numbers of a plurality of display picture elements, wherein said display data generation step processes said plurality of display picture elements as a processing unit, compares a scale number of each of said display picture element and each frame number, in sequential frame number order, and generates display data of said each display picture element based on said comparison results.

18. The method of claim 15, wherein said first scale number is a scale number for an odd number line picture element in a flat type display device and said second scale number is a scale number for an even number line picture element in a flat type display device.

* * * * *

UNITED STATES PATENT AND TRADEMARK OFFICE

CERTIFICATE OF CORRECTION

PATENT NO. : 5,867,137

DATED : February 2,1999

INVENTOR(S) : Mikio Sugiyama

It is certified that error appears in the above-identified patent and that said Letters Patent is hereby corrected as shown below:

Column 3, Line 3 delete "401" and insert --40--

Column 8, Line 29 delete "[0]" and insert --[1]--

Signed and Sealed this

Twenty-ninth Day of June, 1999

*Attest:*

Q. TODD DICKINSON

*Attesting Officer*

*Acting Commissioner of Patents and Trademarks*